United States Patent [19]

Jackson

[11] 4,369,798

[45] Jan. 25, 1983

[54] COMBINATION CIGARETTE HOLDER AND CIGARETTE SMOKE CATCHER

[76] Inventor: Allen C. Jackson, 230 Wroxeter Rd., Rugby Hall, Arnold, Md. 21012

[21] Appl. No.: 289,856

[22] Filed: Aug. 4, 1981

[51] Int. Cl.[3] ..... A24D 3/00; A24D 3/04

[52] U.S. Cl. ..... 131/330; 131/280; 131/187; 131/189; 131/202; 131/206; 131/211; 131/212 R; 131/215 R; 131/215 B

[58] Field of Search ..... 131/271, 180, 187, 189, 131/191, 192, 199, 200, 201, 202, 203, 206, 211, 210, 212 R, 213, 215 R, 215 A, 215 B, 216, 218

[56] References Cited

U.S. PATENT DOCUMENTS

| | | | |
|---|---|---|---|
| 1,696,372 | 12/1928 | Wright | 131/206 |
| 3,713,452 | 1/1973 | D'Elia et al. | 131/215 B |
| 4,184,496 | 1/1980 | Adair | 131/271 |

*Primary Examiner*—V. Millin

*Attorney, Agent, or Firm*—Sughrue, Mion, Zinn, Macpeak & Seas

[57] ABSTRACT

A cigarette holder body terminates at one end in a hollow mouthpiece which opens to a pair of cylindrical passages one of which holds the unlit end of the cigarette while the other holds a smoke catcher cartridge. One way flap valves are interposed between the unlit end of the cigarette and the mouthpiece and downstream of the smoke catcher cartridge which automatically open and close oppositely such that during inhaling smoke passes through the first passage to the smoker while, during exhaling smoke is forced to pass through the other passage bearing the smoke catcher cartridge. The body may comprise a hinged two-part plastic molding snap latched to closed position and bearing integral opening tabs on respective body halves.

5 Claims, 7 Drawing Figures

FIG. 2
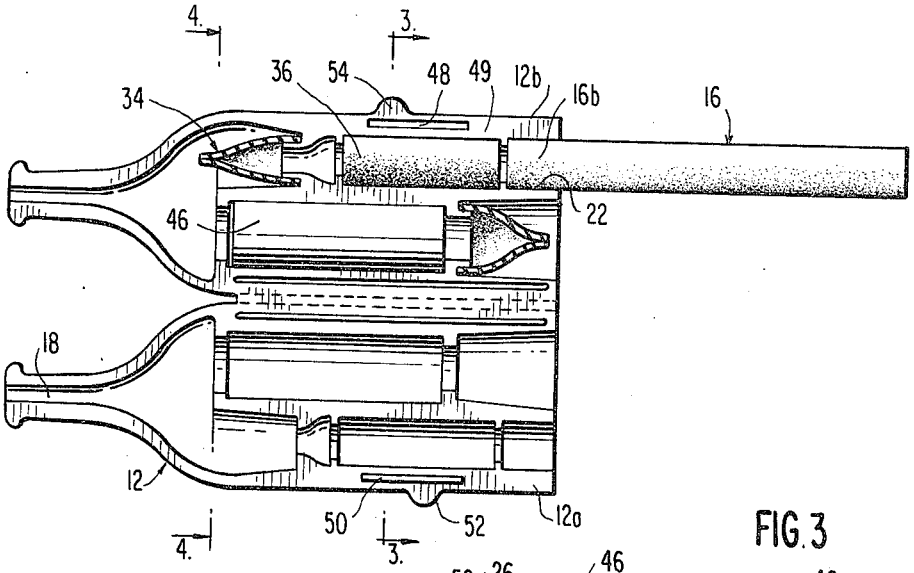
FIG. 1
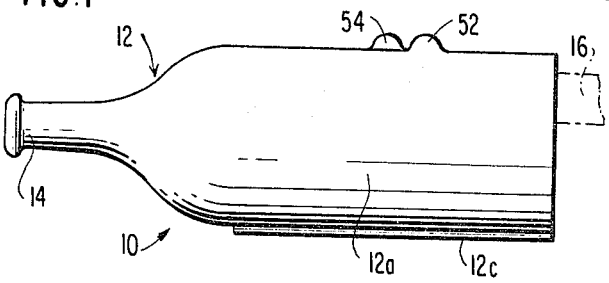
FIG. 3
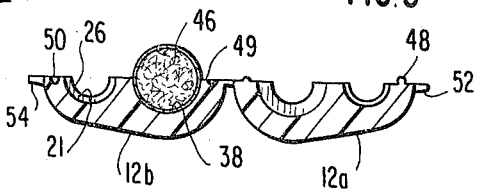
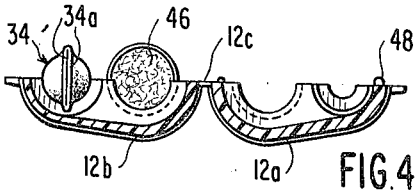
FIG. 4
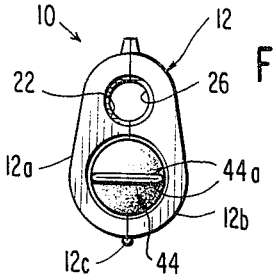
FIG. 5
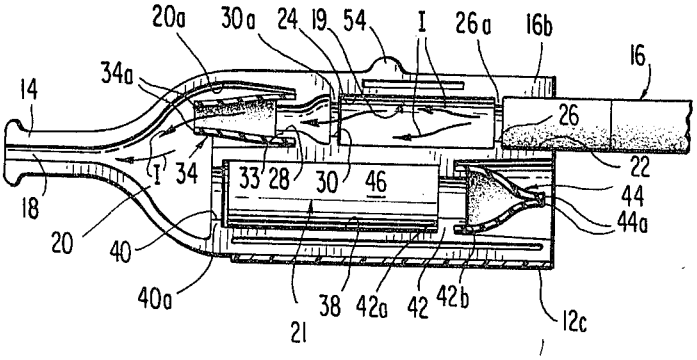
FIG. 6
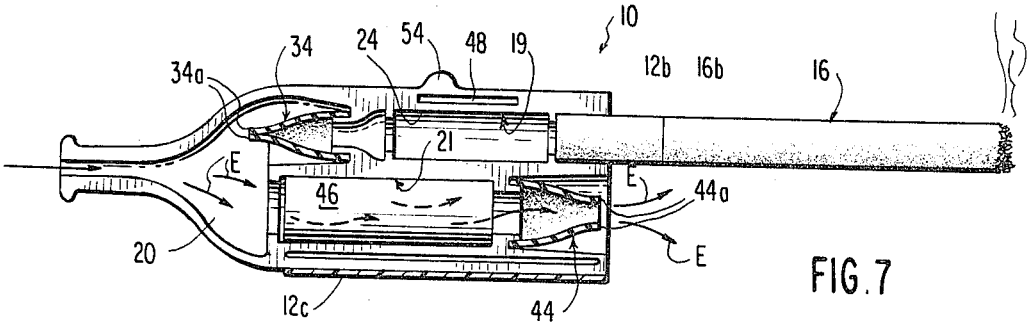
FIG. 7

COMBINATION CIGARETTE HOLDER AND CIGARETTE SMOKE CATCHER

BACKGROUND OF THE INVENTION

Cigarette holders have evolved over the years formed of plastic or like material and normally including a singular axial cavity leading from the mouthpiece at one end of the body and extending through the body. A filtered or non-filtered type cigarette is supported by the body with the unlit end projecting inwardly thereof and within the cylindrical cavity. Where cigarettes do not have an integral filter some cigarette holders include a special cavity upstream intermediate of the area bearing the unlit end of the cigarette and the mouthpiece for holding a separate, removable filter cartridge.

Attempts have been made to cause the smoke from the cigarette to flow along diverse paths during smoking. U.S. Pat. No. 1,816,139 is directed to a cigar or cigarette holder where during inhaling, the smoke flows along one confined path to the mouthpiece while, during exhaling, the smoke is exhaled through a separate path as for instance through a nose opening in a face pictured at one end of the holder. Such ideas are purely for novelty purposes. In more recent U.S. Pat. No. 4,083,374 a cigarette holder includes a valve member functioning to vary the flow path during inhaling and exhaling and permitting during exhaling the smoke to be captured within a bag within the alternate flow path. In such case, the smoke is reused over many times to maximize the flavor in the smoke.

SUMMARY OF THE INVENTION

The present invention is directed to an improved cigarette holder utilizing two flow paths and comprising a holder body bearing a hollow mouthpiece at one end which communicates to a pair of parallel cylindrical passages both of which open at the opposite end to the exterior of the body. One of the passages bears the unlit end of a cigarette while the other passage bears a smoke catcher filter cartridge. Further a projection on the center line contact face of one of the body halves is snap fitted into an aligned recess within the center line contact face of the opposite body half to lock the pivotable body halves together. A removable smoke catcher filter cartridge may be placed within one passage and the unlit end of the cigarette is positioned within the other of said passages. A second cigarette filter cartridge may be provided within a portion of the passage bearing the unlit end of the cigarette, in juxtaposition to the end of that cigarette and intermediate the cigarette and the upstream flap valve.

BRIEF DESCRIPTION OF THE DRAWINGS

FIG. 1 is a top plan view of the improved cigarette holder with integral smoke catcher, forming one embodiment of the present invention.

FIG. 2 is a top plan view of the cigarette holder of FIG. 1, with the body sections pivoted to open position permitting placement of a smoke catcher filter cartridge, a cigarette filter cartridge, and an unlit cigarette within one of the holder halves prior to closing of the holder halves.

FIG. 3 is a vertical sectional view of the cigarette holder shown in FIG. 2, taken about line 3—3.

FIG. 4 is a further vertical sectional view of the cigarette holder of FIG. 2 taken about line 4—4.

FIG. 5 is a front elevational view of the cigarette holder with the body halves closed.

FIG. 6 is a sectional view of the cigarette holder of FIG. 1 during inhaling.

FIG. 7 is a similar sectional view to that of FIG. 6, during exhaling.

DESCRIPTION OF THE PREFERRED EMBODIMENT

Referring to the figures, the improved cigarette holder with integral smoke catcher is illustrated generally at 10 and comprises a molded plastic, two-part or hinged body. In the illustrated form, the body is indicated generally at 12. The body is of generally rectangular plan configuration, FIG. 1, with a reduced thickness mouthpiece at 14. The body is formed of two halves as at **12*a*, 12*b*, being hinged together by means of an integral "plastic hinge" 12*c*. The function of the cigarette holder as in all cigarette holders is to comfortably carry a cigarette as at 16 whose lit end, that is, the end which is ignited, being remote from the holder mouthpiece while its unlit end 16*b* is carried internally of the holder 10. The mouthpiece 14 is provided with a central bore as at 18 which opens to an enlarged cavity 20 within that end of the body adjacent mouthpiece 14. The body cavity 20 is bifurcated into parallel flow passages, 19, 21, one 21 of which bears a smoke catcher filter cartridge indicated at 46 of cylindrical form while, the other passage 19 bears, at least, the unlit end 16*b* of the cigarette 16. It may additionally bear a separate cigarette filter cartridge as at 36 abutting or closely spaced to the unlit end 16*b* of cigarette 16**.

The cigarette bearing passage 19 is composed of a short-length cylindrical portion 22 within which closely fits the unlit end **16*b* of cigarette 16. As shown in FIG. 6 where the cigarette constitutes a filter cigarette and in which case, the end 16*b* of the cigarette is the filter end, the filter end or a portion thereof fits closely to passage portion 22 and abutting a shoulder 26*a* formed by reduced diameter portion 26 of the passage. Extending over a considerable length of the passage 19 is a larger diameter portion 24 within which may selectively fit a separate cigarette filter as at 36, FIG. 2. The passage portion 24 terminates at its end nearest the mouthpiece 14, in a reduced diameter portion 30 also forming an axial shoulder 30*a*. Rearward of the shoulder 30*a* is a reduced diameter passage portion 28 which opens to an even larger diameter portion 20*a* which extends from cavity 20. An annular ring or annular lip 33 mounts a first, unitary, flexible one-way flap valve 34. The flap valve 34 terminates at one end in two flat lips 34*a* which, automatically close when air is forced to flow from left to right through the body during exhaling, but automatically open during inhaling, see FIGS. 6 and 7. Within both body halves 12*a* and 12*b*, semi-cylindrical parallel cavities are formed such that, when the body halves are pivoted to closed position, FIGS. 5, 6 and 7, side-by-side and somewhat parallel flow paths are provided for the cigarette smoke defined by respective passages 19 and 21. As may be further appreciated, passage 21 is formed with major portion 38, the diameter of which holds closely a smoke catcher filter cartridge 46 whose abuts shoulders 40*a* and 42*a* defined by reduced diameter portions 40 and 42 thereof. Further, an annular lip 42*b* is formed at the downstream end of the passage 46 permitting the mounting of flexible, one way flap valve 44 to lip 42*b*. Again, this second flap valve terminates at the end remote from its mounting end to annular lip 42b, in valve lips 44a which press together during inhaling but which open freely during exhaling as seen in contrasting FIGS. 6 and 7. Preferably, the flap valves 34, 44 are unitary, may be formed of rubber or other resilient material and are known, per se. Alternatively, instead of using the paired, oppositely directed, one-way flap valves 34 and 44 for respective flow passages during inhaling and exhaling, a single mechanical valve member may be employed for selectively shutting off flow paths defined by passages 19 and 21**, the valve member being operated by the smoker and shifted during inhaling and exhaling in alternating open passage fashion.

As may be appreciated by viewing FIGS. 3 and 4, the body halves 12a and 12b are integrally hinged by way of a thin segment of plastic material as at 12c. Halve 12b is integrally provided with an elongated projecting rib or latch member as at 48 projecting outwardly from flat face 49 of body section 12b. On the opposite flat mating face 51 of body section half 12a, is provided, an elongated groove or recess as at 50 within which, the latch bead 48 frictionally seats to frictionally latch the two halves together, in the manner shown in FIG. 1 and FIG. 5. Further, opening tabs 52 and 54 are provided to section halves 12a and 12b, along edges thereof such that, by oppositely exerting forces through a thumb and finger on respective tabs 52, 54, the pivotable case-like body 12 may be readily opened to permit selectively, replacement of a cigarette as at 16, a smoke catcher filter cartridge as at 46 or a separate cigarette cartridge 36 (when such is required).

As may be appreciated by further reference to FIG. 6, when the mouthpiece 14 is inserted in the smoker's mouth and between the smoker's lips during inhaling as indicated by arrows I, the smoke enters the smoker's mouth. Smoke from the lit end 16a of the cigarette passes by way of arrows I through the integral filter 16b at the unlit end 16b of the cigarette, through the passage 19 providing an inhale flow path. Flow is through the enlarged diameter portion 24 of passage 19 (alternatively housing a separate cigarette filter which may be in cartridge form, as indicated at 36, FIG. 2) and, passes through the separated lips 34a of the flap valve 34 to freely enter the smoker's mouth and/or lungs as the case may be. It should be noted in FIG. 6 that, during inhaling, the lips 44a of the flap valve 44 in the second passage 21 (the exhaling flow passage) are closed by the suction action, and air may enter the interior of the cigarette holder body 10 only through the burning cigarette and thus bearing the smoke (not removed by the filter borne by the filter-type cigarette 16) to the smoker.

During exhaling as indicated in FIG. 7, smoke as indicated by arrows E, is forced back into the cigarette holder body 12 through the bore 18 of the mouthpiece 14, and upon entering the chamber 20, is forced to flow through the second flow passage 21 since, during exhaling the lips 34a of the flap valve 34 associated with the cigarette-bearing cavity 19 are closed thus, all of the exhaled smoke must pass through the smoke catcher filter cartridge 46 borne within the cavity portion 38. Air exits as indicated by arrows A through the now open flaps 44a of flap valve 44, the air entering the room as indated by arrows A, FIG. 7. Such a cigarette holder permits smoking in a room with minimal irritation to the non-smokers since, most of the smoke normally filling the room comes from the lungs or mouth of the smoker after initial inhaling and upon exhaling rather than from the mere presence of a burning cigarette. The smoke catcher filter cartridge may comprise charcoal, paper, a combination of these materials or other materials conventionally employed in the filtering of smoke from burning tobacco. The filter 46 may be patterned after that being somewhat larger than filter 36. Both may be constructed similar to the integral filter provided within nonburning end 16b of the cigarette 16 as illustrated in FIGS. 6 and 7.

While the invention has been particularly shown and described with reference to a preferred embodiment thereof, it will be understood by those skilled in the art that various changes in form and details may be made therein without departing from the spirit and scope of the invention.

What is claimed is:

1. An improved cigarette holder for holding a cigarette or the like during smoking, said holder comprising: a holder body, a hollow mouthpiece for said body, a pair of airflow passages within said body in communication respectively at one end, to said hollow mouthpiece, said passages opening at their other ends to the exterior of said body remote from said mouthpiece, one of said passages adapted to closely hold the unlighted end of a cigarette whose lighted end projects outwardly of said body and the other of said passages bearing a smoke catcher filter and wherein said body includes first valve means for selectively allowing air flow through the cigarette in said one passage to the smoker via the mouthpiece during inhaling and second valve means in said second passage for selectively allowing flow outwardly of the body through said second passage bearing said smoke catcher filter during exhaling.

2. The cigarette holder as claimed in claim 1, wherein said first valve means comprises a first one-way flap valve within said one passage, downstream of said cigarette with respect to airflow from the cigarette to the mouthpiece during inhaling, and said second valve means comprises a second, oppositely oreinted one-way flap valve within said second passage, downstream of said smoke catcher cartridge with respect to air flowing from said mouthpiece, during exhaling.

3. The cigarette holder as claimed in claim 2 wherein said body comprises a hinged body including two center line mating flat faces including semi-cylindrical recesses therein defining cylindrical passages for holding said unlit end of said cigarette and said smoke catcher filter cartridge respectively.

4. The cigarette holder as claimed in claim 3 wherein said one passage includes a portion intermediate of the portion bearing the unlit end of the cigarette and the portion bearing said flap valve for bearing an optional auxiliary cigarette filter.

5. The cigarette holder as claimed in claim 4 further comprising an integral latch projection molded to one of said body halves and projecting outwardly of the body center contact face and wherein, the body half center line contact face of said other half includes a recess sized to said projection and frictionally receiving the same to lock said pivotable hinged body halves together and wherein, each of said halves includes an integral opening tab projecting outwardly of the body half along one side thereof opposite the hinge point, said tabs being longitudinally spaced from each other whereby, finger and thumb pressure on respective opening tabs permits the body halves to be snapped open to facilitate removal and replacement of any one of the cigarette, the smoke catcher filter cartridge and the auxiliary cigarette filter.

* * * * *